US011352174B2

(12) United States Patent
Klatt

(10) Patent No.: US 11,352,174 B2
(45) Date of Patent: Jun. 7, 2022

(54) BUNG PLUG CLOSURE FOR BUNG-HOLE CONTAINERS

(71) Applicant: Schuetz GmbH & Co. KGaA, Selters (DE)

(72) Inventor: Bernd Klatt, Ruppach-Goldhausen (DE)

(73) Assignee: SCHUETZ GMBH & CO. KGAA, Selters (DE)

( * ) Notice: Subject to any disclaimer, the term of this patent is extended or adjusted under 35 U.S.C. 154(b) by 85 days.

(21) Appl. No.: 16/968,348

(22) PCT Filed: Jan. 10, 2019

(86) PCT No.: PCT/EP2019/050521
§ 371 (c)(1),
(2) Date: Aug. 7, 2020

(87) PCT Pub. No.: WO2019/158283
PCT Pub. Date: Aug. 22, 2019

(65) Prior Publication Data

US 2020/0391908 A1 Dec. 17, 2020

(30) Foreign Application Priority Data

Feb. 13, 2018 (DE) ..... 10 2018 103 137.8

(51) Int. Cl.
*B65D 39/08* (2006.01)
*B65D 51/16* (2006.01)

(52) U.S. Cl.
CPC ..... *B65D 39/086* (2013.01); *B65D 51/1644* (2013.01); *B65D 2205/00* (2013.01)

(58) Field of Classification Search
CPC .... B65D 39/086; B65D 39/082; B65D 39/08; B65D 51/1644; B65D 51/1633;
(Continued)

(56) References Cited

U.S. PATENT DOCUMENTS 1,701,816 A * 2/1929 Mulluk ..... F16J 13/02 220/210
5,499,654 A 3/1996 Shefte
(Continued)

FOREIGN PATENT DOCUMENTS

DE 921729 C 12/1954
DE 29513256 U1 12/1995
(Continued)

*Primary Examiner* — Robert J Hicks
(74) *Attorney, Agent, or Firm* — Dickinson Wright PLLC; Andrew D. Dorisio

(57) ABSTRACT

A bung plug closure for bung-hole containers includes a bung plug for being placed in a bung neck and a seal cap for closing a plug recess formed in the bung plug, the plug recess having a space for receiving a dimensionally elastic engaging body formed on the seal cap and having a radial locking protrusion, a valve disposed in a bottom of the plug recess, the valve having a valve body disposed in a valve opening of a bottom recess, the valve body including a valve cover connected to the bung plug, the valve cover being an elastically deformable disk, the valve cover connected to the bung plug such that a circumferential edge of the valve cover, which protrudes radially outward over matching locking elements for interlocking with the locking protrusion, is received between the locking protrusion of the engaging body and a recess edge of the bottom recess.

7 Claims, 2 Drawing Sheets

(58) Field of Classification Search
CPC ..... B65D 51/16; B65D 51/18; B65D 51/24; F16K 24/04
USPC ... 220/259.4, 259.3, 257.1, 256.1, 212, 373, 220/367.1, 203.19, 203.29, 203.01, 220/203.22
See application file for complete search history.

(56) References Cited

U.S. PATENT DOCUMENTS

| | | | | |
|---|---|---|---|---|
| 5,649,639 | A | 7/1997 | Dolvet et al. | |
| 10,787,294 | B2 * | 9/2020 | Pree | F16K 17/18 |
| 2006/0096985 | A1 | 5/2006 | Stolzman | |
| 2009/0140196 | A1 | 6/2009 | Minegishi et al. | |
| 2010/0301046 | A1 | 12/2010 | Schuetz | |
| 2011/0198349 | A1 * | 8/2011 | Lane | A47G 19/2272 220/203.04 |
| 2013/0341550 | A1 | 12/2013 | Fukano et al. | |

FOREIGN PATENT DOCUMENTS

| | | | |
|---|---|---|---|
| DE | 29608342 | U1 | 7/1996 |
| DE | 202015008399 | U1 | 2/2016 |
| EP | 0922649 | A1 | 6/1999 |
| EP | 2256056 | A1 | 12/2010 |

* cited by examiner

Fig. 1
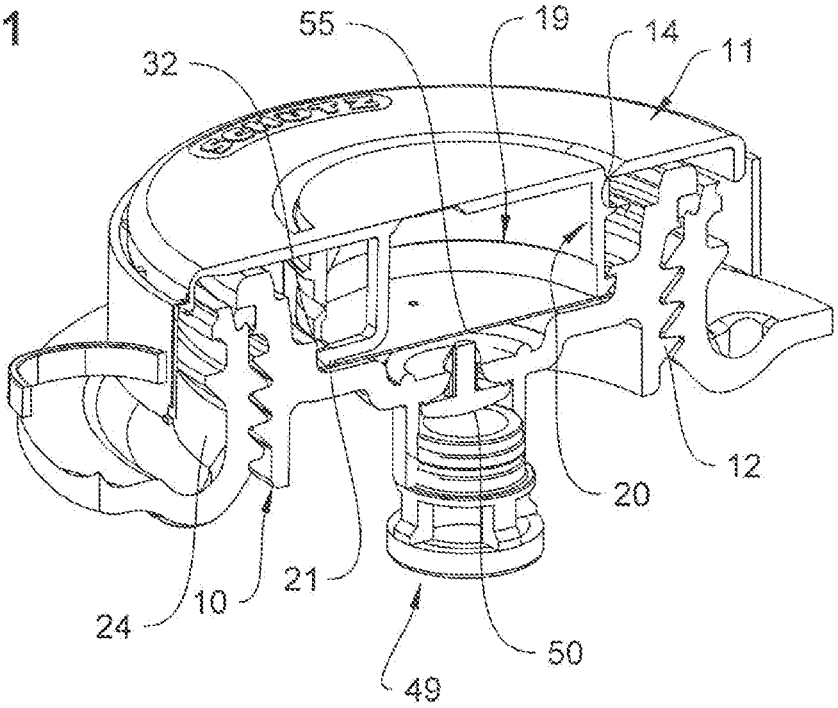
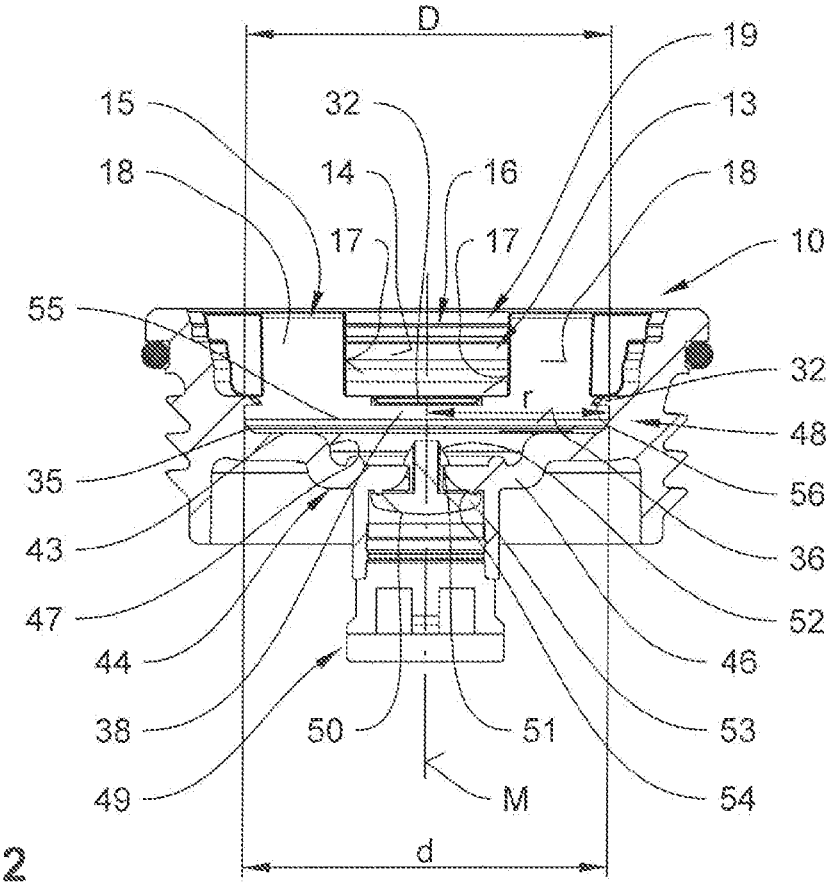
Fig. 2

Fig. 3
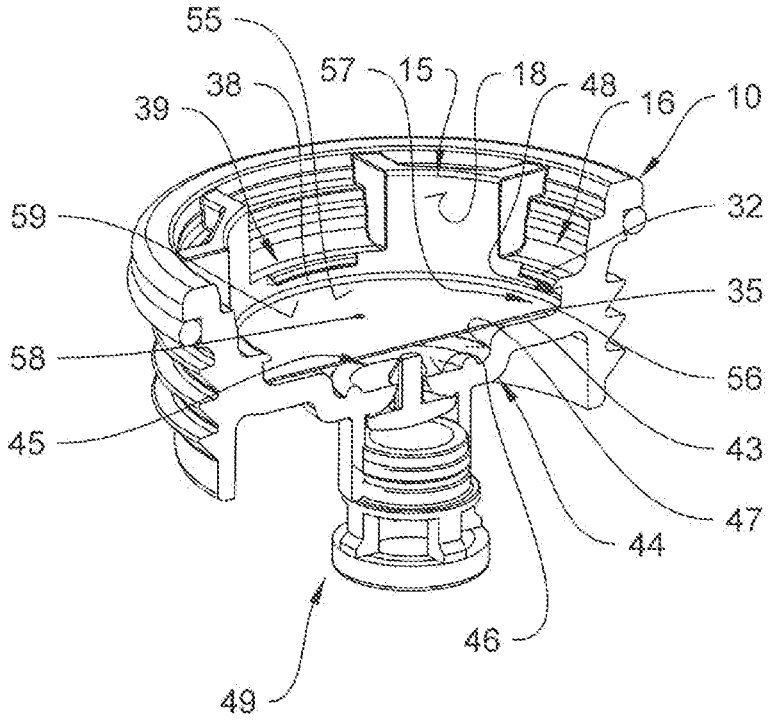
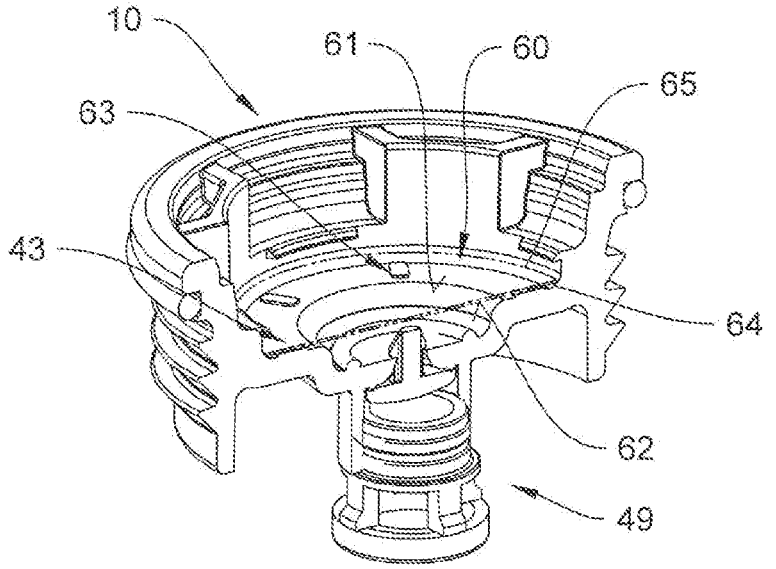
Fig. 4

BUNG PLUG CLOSURE FOR BUNG-HOLE CONTAINERS

TECHNICAL FIELD

The present invention relates to a bung plug closure for bung-hole containers, the bung plug closure comprising a bung plug for being placed in a bung neck of the bung-hole container and a seal cap for closing a plug recess formed in the bung plug, the plug recess having a receiving space for receiving a dimensionally elastic engaging body which is formed on the seal cap and which is provided with a radial locking protrusion, and the bung plug having key projections which are spaced apart from each other by gaps, are disposed on an interior wall of the plug recess and whose inner surfaces define the receiving space, matching locking elements for interlocking with the locking protrusion of the engaging body being provided in the plug recess and protruding radially inward over the locking protrusion of the engaging body after interlocking, a valve being disposed in a bottom of the plug recess, said valve having a valve body which is disposed in a valve opening of a bottom recess, said valve body being provided with a valve cover which is connected to the bung plug and which is provided with a vent.

BACKGROUND OF THE INVENTION

Bung plug closures of the kind mentioned above are used to close liquid containers, which can be designed in particular as barrels or as inner containers for intermediate bulk containers (IBCs). To be able to equalize the pressure within the container interior with the surroundings of the container, bung plug closures of this kind are provided with a valve depending on the type of liquid held in the container, said valve being formed on the bung neck and disposed in the bottom of the plug recess and having a valve body which is disposed in a valve opening of the bottom recess and which allows air to flow through the valve for pressure compensation.

The known valves typically have a dimensionally elastic valve body which is disposed in a valve opening formed in the bottom recess of the bung plug. To prevent damage to the valve body, the valve is provided with a valve cover, which is a plastic grid welded to the bung plug.

The valve seal formed on the known bung plugs does provide effective protection of the valve body without affecting the valve function because the grid structure does not only act as protection but also forms a vent which allows air to flow through the valve despite the valve body being covered. However, installation of the valve cover, which requires welding in order to connect the valve cover to the bung plug, involves significant effort.

SUMMARY OF THE INVENTION

Hence, the object of the present invention is to propose a bung plug closure that allows a valve equipped with a valve cover to be provided with relatively little production effort.

To attain said object, the bung plug closure according to the invention has the features of claim 1.

According to the invention, the valve cover is an elastically deformable disk whose diameter d is smaller than a diameter D of the receiving space, the valve cover being connected to the bung plug in such a manner that a circumferential edge of the valve cover, which protrudes radially outward over the matching locking elements, is received between the locking protrusion of the engaging body and a recess edge of the bottom recess.

By disposing the valve cover between the locking protrusion of the engaging body and the recess edge of the bottom recess, the position of the valve cover relative to the valve is secured solely by the connection between the seal cap and the bung plug, said connection being required anyway, thus rendering any additional measures beyond the connection between the two aforementioned components of the bung plug closure unnecessary.

Even if the seal cap is removed from the bung plug closure, the connection still remaining between the valve cover and the bung plug ensures that the valve cover is securely positioned on the bung plug because the valve cover is received between the matching locking elements formed in the plug recess and the recess edge.

For installation, the valve cover, whose diameter is at least slightly smaller than the diameter of the receiving space, can be inserted until it comes into contact with the matching locking elements and can ultimately be inserted into the bung plug past the matching locking elements, in the course of which it is elastically deformed, and further in the direction of the bottom recess until it reaches the position in which it covers the valve.

If, according to a preferred embodiment, the connection between the valve cover and the bung plug is a clamped connection in such a manner that the valve cover is received in an axially clamped manner between the engaging body of the seal cap, which is received in the plug recess in an interlocking manner, and the recess edge even transport and handling of the container cannot affect the defined position of the valve cover relative to the valve.

Preferably, the key projections are connected to each other by gap platforms in the area of the gaps in such a manner that front surfaces of the gap platforms, which face radially inward, and lower surface portions of the inner surfaces of the key projections, which are adjacent to the recess edge, together form an enclosure radially defining the recess edge. In this way, the circumferential edge of the valve cover is received in the bung plug across its entire circumference, which means that in addition to the protective effect, protection against pollution of the valve by radial entry of dust is ensured.

Preferably, the matching locking elements are disposed at the front surfaces of the gap platforms in the area of the gaps so that for installing the valve cover by axial introduction of the valve cover into the plug recess, a handling tool for automatically installing the valve cover in the bung plug can be used immediately adjacent to the matching locking elements without risking collision with the key projections.

It proves particularly advantageous if the inner surfaces of the key projections and the front surfaces of the gap platforms form a continuous guiding surface during introduction of the valve cover into the plug recess in such a manner that the inner surfaces and the front surfaces form guiding surfaces for radially guiding the circumferential edge of the valve cover until the valve cover comes into contact with the recess edge.

If the valve cover is a cover disk whose surface is closed except for a ventilation opening for forming the vent, the effect of the cover disk as protection against pollution for the valve can be improved even further without affecting ventilation.

Ensuring that sufficient air can flow through the valve while the surface of the cover disk is completely closed is possible if the valve cover is a cover disk having a closed surface and a spacer for forming the vent as a ventilation gap, said spacer being formed at an underside of the cover disk or at the recess edge of the bung plug.

BRIEF DESCRIPTION OF THE DRAWING FIGURES

Hereinafter, preferred embodiments of the bung plug closure will be explained in more detail with reference to the drawing.

FIG. 1 shows a bung plug closure placed on a bung neck of a container, the bung plug closure having a bung plug which is screwed into the bung neck and which is provided with a seal cap;

FIG. 2 is an individual illustration of the bung plug shown FIG. 1, the bung plug having a valve disposed in a recess bottom of the bung plug, the valve being provided with a valve cover;

FIG. 3 is an isometric section view of the bung plug illustrated in FIG. 2;

FIG. 4 shows the bung plug of FIG. 3 with a modified valve cover.

DETAILED DESCRIPTION OF THE INVENTION

FIG. 1 shows a bung plug closure comprising a seal cap 11 disposed on a bung plug 10. Bung plug 10 is provided with an external thread 12 for being screwed into a bung neck 24. As shown in FIG. 2 in particular, bung plug 10 has a plug recess 13 which has key projections 15 formed on an interior wall 14 of plug recess 13, said key projections 15 being separated from each other by gaps 16. In the circumferential direction of bung plug 10, gaps 16 are defined by driving surfaces 17 which serve to come into contact with radial drivers of a bung plug key (not illustrated) introduced into plug recess 13 so as to deliver a screwing torque to bung plug 10 in order to screw in or unscrew bung plug 10.

As can be seen from a combined view of FIGS. 1 and 2, concave inner surfaces 18 of key projections 15 additionally define a receiving space 19 formed within plug recess 13 for receiving an engaging body 20 which is disposed on seal cap 11 and a lower end of which is provided with an annular locking protrusion 21. Bung plug 10 has matching locking elements 32 for interlocking annular locking protrusion 21 with bung plug 10. Matching locking elements 32 are disposed above an annular enclosure 35 which is formed outside of gaps 16, which separate key projections 15, by lower portions 36 of inner surfaces 18 of key projections 15, inner surfaces 18 preferably being concave. Hence, enclosure 35 has both portions 36 of inner surfaces 18 and other portions in the area of gaps 16, said other portions being formed by front surfaces 38 of gap platforms 39 formed in gaps 34. As can be seen in FIG. 2 in particular, in the illustrated embodiment, enclosure 35 is a continuously circumferential cylinder wall surface having a constant curvature radius r with respect to a center axis M of bung plug 31.

As shown in FIGS. 2 and 3, in the area of gaps 16, annular enclosure 35 is defined by matching locking elements 32, which extend radially inward. At the bottom, annular enclosure 35 is defined by a recess edge 43 of a bottom 44, circumferential edge 43 being higher than a bottom ground 46 so as to form a bottom recess 45. In the area of gaps 16, bung plug 31 has a plug cross-section 48 that drops radially inward in a stepped manner from matching locking element 32 via enclosure 35, recess edge 43 of bottom 44 and a sleeve-shaped shoulder 47 formed in the area of transition to bottom ground 46.

As illustrated in FIGS. 1 and 2, a valve 49 is disposed in recess bottom 44 of bung plug 10, said valve 49 having a valve body 50 which is inserted into a valve opening 51 formed in bottom ground 46. Valve body 51 is an approximately mushroom-shaped elastic molded body having a stem-shaped attachment part 52 and a valve lid 53 formed adjacent thereto. Valve lid 53 forms a seal against an annular collar-shaped valve seat 54, which is formed at the underside of bottom ground 46, in such a manner that when the pressure above bottom 44 is higher than the pressure within the container, the valve opens and fluid communication between the container interior and the environment is established via valve ducts 54 formed at the circumference of attachment part 42 and a valve gap (not illustrated) caused to form between valve lid 53 and valve seat 54 by the higher pressure.

As shown in FIGS. 2 and 3, valve 49 is provided with a disk-shaped valve cover 55 which is made of a dimensionally elastic plastic, such as PE, and which has a circumferential edge 56 protruding radially outward over the matching locking elements 32 and received between matching locking elements 32 and recess edge 43 in the axial direction. In the radial direction, valve cover 55 is kept in position by enclosure 35, which, as explained above, is formed by front surfaces 38 of gap platforms 39 and lower surface portions 36 of inner surfaces 18 of key projections 15.

As can be gathered from the illustration in FIG. 3 in particular, installation, i.e. axial insertion of valve cover 55 into plug recess 13 until valve cover 55 comes into contact with recess edge 43 takes place in such a manner that inner surfaces 18 of key projections 15 and front surfaces 38 of gap platforms 39 form a continuous guiding surface in plug recess 13 in such a manner that circumferential edge 56 of valve cover 55, whose diameter d is at least slightly smaller than diameter D of receiving space 19 formed in plug recess 13 (FIG. 2), is first guided until it comes into axial contact with matching locking elements 32, is then elastically deformed so as to pass matching locking elements 32 and, after having passed matching locking elements 32, reaches the position at bottom 44 as illustrated in FIGS. 2 and 3.

As soon as valve cover 55 has reached the position illustrated in FIGS. 2 and 3, in which valve cover 55 is mobile, in a manner secured against dropping out, with bung plug 10 and only within a receiving space 57 formed between matching locking elements 32 and recess edge 43, valve cover 55 fulfils its function as dust protection so as to prevent dirt from depositing on valve body 50, which might adversely affect the valve function.

Moreover, once engaging body 20 of seal cap 11 has been inserted into plug recess 13 in such a manner that locking protrusion 11, which is annular in this case and formed at the bottom edge of engaging body 20, is locked behind matching locking elements 32 as illustrated in FIG. 1, the connection between valve cover 55 and bung plug 10 is additionally a clamped connection in such a manner that valve cover 55 is now received in an axially clamped manner between locking protrusion 21 of engaging body 20, which is received in an interlocking manner in plug recess 13, and recess edge 43.

A comparison of the embodiments illustrated in FIGS. 3 and 4 shows that, valve cover 55 notwithstanding, which is a cover disk whose surface 59 is closed except for a vent opening 58, a valve cover 60 which has a completely closed surface 61 may also be provided. To ensure free gas exchange between the surroundings and the inside of a container via valve 49, underside 62 of valve cover 60 rests on spacer bodies 63 which are formed on recess edge 43 in order to form a ventilation gap 64 between a circumferential edge 65 of valve cover 60 and recess edge 43.

The invention claimed is:

1. A bung plug closure for bung-hole containers, the bung plug closure comprising a bung plug (10) for being placed in a bung neck (24) of the bung-hole container and a seal cap (11) for closing a plug recess (13) formed in the bung plug (10), the plug recess (13) having a receiving space (19) for receiving a dimensionally elastic engaging body (20) which is formed on the seal cap (11) and which is provided with a radial locking protrusion (21), and the bung plug (10) having key projections (15), which are spaced apart from each other by gaps (16), are disposed on an interior wall (14) of the plug recess (13) and whose inner surfaces (18) define the receiving space (19), matching locking elements (32) for interlocking with the locking protrusion (21) of the engaging body (20) being provided in the plug recess (10) and protruding radially inward over the locking protrusion (21) of the engaging body (20) after interlocking, a valve (49) being disposed in a bottom (44) of the plug recess (13), said valve (49) having a valve body (50) which is disposed in a valve opening (51) of a bottom recess (45), said valve body (50) being provided with a valve cover (55, 60) which is connected to the bung plug (10) and which is provided with a vent (58, 64), characterized in that the valve cover (55, 60) is an elastically deformable disk whose diameter (d) is smaller than a diameter (D) of the receiving space (19), the valve cover (55, 60) being connected to the bung plug (10) in such a manner that a circumferential edge (56, 65) of the valve cover (55, 60), which protrudes radially outward over the matching locking elements (32), is received between the locking protrusion (21) of the engaging body (20) and a recess edge (43) of the bottom recess (45).

2. The bung plug closure according to claim 1, wherein the connection is a clamped connection in such a manner that the valve cover (55, 69) is received in an axially clamped manner between the locking protrusion (21) of the engaging body (20) of the seal cap (11) and the recess edge (43), the engaging body (20) being accommodated in an interlocking manner in the plug recess (13).

3. The bung plug closure according to claim 1, wherein the key projections (15) are connected to each other by gap platforms (39) in the area of the gaps (16) in such a manner that front surfaces (38) of the gap platforms (39), which face radially inward, and lower surface portions (36) of the inner surfaces (18) of the key projections (15), which are adjacent to the recess edge (43), together form an enclosure (35) radially defining the recess edge (43).

4. The bung plug closure according to claim 3, wherein, in the area of the gaps (16), the matching locking elements (32) are disposed at the front surfaces (38) of the gap platforms (39).

5. The bung plug closure according to claim 4, wherein, when the valve cover (55, 60) is being introduced into the plug recess (13), the inner surfaces (18) of the key projections (15) and the front surfaces (38) of the gap platforms (39) form a continuous guiding surface in such a manner that the inner surfaces (18) and the front surfaces (38) form guiding surface for axially guiding the circumferential edge (56, 65) of the valve cover (55, 60) until the valve cover (55, 60) comes into contact with the recess edge (43).

6. The bung plug closure according to claim 1, wherein the valve cover (55) is a cover disk whose surface (59) is closed except for a ventilation opening for forming the vent (58).

7. The bung plug closure according to claim 1, wherein the valve cover (60) is a cover disk having a closed surface (61) and a spacer for forming the vent (64) as a vent gap, said spacer being formed at an underside of the cover disk or at the recess edge (43).

* * * * *